US007147145B2

(12) United States Patent
Kortsmit et al.

(10) Patent No.: US 7,147,145 B2
(45) Date of Patent: Dec. 12, 2006

(54) CARTON WITH FOLDED-IN GUSSET TIPS

(75) Inventors: Peter Kortsmit, Mahtomedi, MN (US); Tommy Ljungstrom, Hoor (SE)

(73) Assignee: Tetra Laval Holding & Finance, SA, Pully (CH)

( * ) Notice: Subject to any disclaimer, the term of this patent is extended or adjusted under 35 U.S.C. 154(b) by 0 days.

(21) Appl. No.: 11/163,657

(22) Filed: Oct. 26, 2005

(65) Prior Publication Data

US 2006/0124715 A1 Jun. 15, 2006

Related U.S. Application Data

(63) Continuation-in-part of application No. 11/011,689, filed on Dec. 14, 2004, now abandoned.

(51) Int. Cl.
*B65D 5/08* (2006.01)
*B65D 5/74* (2006.01)

(52) U.S. Cl. ..... 229/137; 229/184

(58) Field of Classification Search ..... 229/137, 229/184, 125.42

See application file for complete search history.

(56) References Cited

U.S. PATENT DOCUMENTS 663,133 A * 12/1900 Shipley, Jr. ..... 229/184
3,412,922 A * 11/1968 Miller et al. ..... 229/184
4,192,446 A * 3/1980 Naito ..... 229/184
4,601,425 A * 7/1986 Bachner ..... 229/179
4,667,873 A * 5/1987 Yasui et al. ..... 229/184
4,702,410 A 10/1987 Derving
4,785,993 A * 11/1988 Lisiecki ..... 229/137
4,819,865 A 4/1989 Lisiecki et al.
5,056,707 A * 10/1991 Larsen ..... 229/184
5,078,315 A * 1/1992 Floberg ..... 229/137
5,636,785 A 6/1997 Kalberer et al.
6,012,267 A * 1/2000 Katsumata ..... 53/425
6,019,279 A * 2/2000 Tywoniuk ..... 229/137
6,182,887 B1 * 2/2001 Ljunstrom et al. ..... 229/137
6,328,204 B1 * 12/2001 Stacy-Ryan ..... 229/137
6,385,950 B1 * 5/2002 Anderson ..... 53/563

OTHER PUBLICATIONS

PCT International Search Report PCT/US2005/042136 dated Apr. 24, 2006.

* cited by examiner

*Primary Examiner*—Gary E. Elkins
(74) *Attorney, Agent, or Firm*—Levenfeld Pearlstein, LLC

(57) ABSTRACT

A package having a bottom wall with in-folded gusset tips includes a plurality of upstanding side walls, each side wall contiguous or sealed to its adjacent side walls, a sealed top and a sealed bottom wall. The sealed bottom wall is formed from opposing leading and trailing panels, intermediate, opposing gusset panels and a sixth panel. The gusset panels are folded inwardly toward one another to form triangular panels. The triangular panels are disposed interior of the leading and trailing panels. The ends of the gusset panels define triangular tips that are folded away from one another. The sixth panel has a length that is less than or equal to the distance between the gusset tips.

7 Claims, 2 Drawing Sheets

CARTON WITH FOLDED-IN GUSSET TIPS

CROSS-REFERENCE TO RELATED APPLICATION DATA

This application is a continuation-in-part of U.S. patent application Ser. No. 11/011,689, filed Dec. 14, 2004, now abandoned.

BACKGROUND OF THE INVENTION

The present invention pertains to a carton having a folded and sealed bottom wall. More particularly, the present invention pertains to a carton having a bottom wall having folded-in gusset tips.

One common form of container for milk, juice and the like is the gable top carton. Recently, packaging technology has made enormous strides vis-à-vis these gable top cartons, as well as other types of packages. At present, technology permits packaging perishable food items for non-refrigerated extended shelf lives. These packages provide the ability to bring these food items into parts of the world that have limited transportation, distribution and storage infrastructure.

In view of this, efforts have been made to increase the high standards of cleanliness in the formed, filled and sealed containers to provide the highest quality product and to provide the greatest product shelf life. And, in conjunction with this, the demands on the overall packaging processes have been maintained vis-à-vis machine operating speeds. Such machines must form, fill and seal packages, in a sterile environment, at high operating speeds.

In order to maintain the integrity of the package after it is filled and sealed, advanced technologies have been applied to the carton materials, as well as the processing operations. Many such packaging materials are formed from paperboard or fiberboard-based materials formed in a composite structure. Typically, one or more layers, such as polymeric coatings, foil coatings and the like, are applied to the paperboard or fiberboard substrate to reduce or eliminate the gas and liquid permeability of the substrate material.

It has been found that one avenue for providing an environment that reduces the shelf life is wicking of the food product into the package material. Wicking occurs at the edges of the material that are exposed to the food product. Typically, wicking occurs at the raw or exposed edges of the bottom wall panels as they are folded to form the bottom wall. To this end, it has been found desirable to reduce the amount or extent of exposed edges, and in particular at the bottom wall. It has also been found that the foil at the tips of the gussets (the in-folded triangular panels) can crack thus exposing the paperboard substrate material.

One package that has affected a reduction in wicking is disclosed in U.S. Pat. No. 6,328,204 to Stacy-Ryan and an apparatus to form such an over-folded bottom is disclosed in U.S. Pat. No. 6,385,950 to Anderson, both of which patents are commonly assigned with the present application and are incorporated herein by reference. While this over-folded bottom served to "cover" the exposed edges from the bottom front or rear panel, the increase in material required was undesirable.

Accordingly, there exists a need for a carton bottom folding configuration that reduces or eliminates the raw (exposed) paper edges within the carton product storage region. Desirably, such a carton uses, for the most part, a traditional creasing, folding and sealing configuration. Most desirably, such a carton can be formed on known form, fill and seal packaging machines (with minimal modification) and using less packaging material than known over-folded bottom arrangements.

BRIEF SUMMARY OF THE INVENTION

A package having a bottom wall with in-folded gusset tips includes a plurality of, preferably four, upstanding side walls, each side wall contiguous or sealed to its adjacent side walls. The package has a sealed top, such as the familiar gable top, and a sealed bottom wall. The sealed bottom wall is formed from opposing leading and trailing panels and intermediate, opposing gusset panels. The gusset panels are folded inwardly toward one another to form triangular panels. The triangular panels are disposed interior of the leading and trailing panels. The ends of the gusset panels define triangular tips that are folded away from one another.

In a present package, the triangular tips are disposed between the triangular gusset panels and the leading and trailing panels, and the leading panel is sealed over the trailing panel. The triangular tips are spaced a predetermined distance from one another.

A sixth panel is contiguous with the trailing panel. The sixth panel is folded rearwardly so as to lie between the leading and trailing panels. The sixth panel has a length that is less than the distance between the triangular panel tips. A blank for forming the package is also disclosed.

These and other features and advantages of the present invention will be apparent from the following detailed description, in conjunction with the appended claims.

BRIEF DESCRIPTION OF THE SEVERAL VIEWS OF THE DRAWINGS

The benefits and advantages of the present invention will become more readily apparent to those of ordinary skill in the relevant art after reviewing the following detailed description and accompanying drawings, wherein.

DETAILED DESCRIPTION OF THE INVENTION

Figure 1:
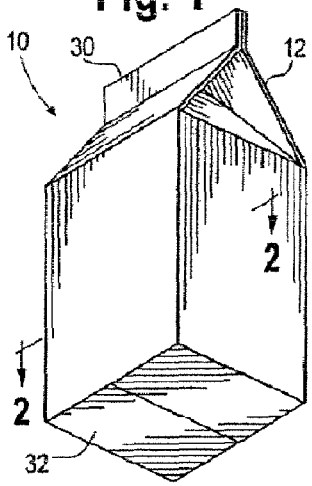
FIG. 1 is a perspective view of an exemplary carton embodying the principles of the present invention.

While the present invention is susceptible of embodiment in various forms, there is shown in the drawings and will hereinafter be described a presently preferred embodiment with the understanding that the present disclosure is to be considered an exemplification of the invention and is not intended to limit the invention to the specific embodiment illustrated.

It should be further understood that the title of this section of this specification, namely, "Detailed Description Of The Invention", relates to a requirement of the United States Patent Office, and does not imply, nor should be inferred to limit the subject matter disclosed herein.

An embodiment of the package 10 in accordance with the principles of the present invention is illustrated in FIG. 1. The package 10 can include an optional closure, such as a threaded cap or flip-type cap (not shown). The package 10 appears to be a conventional package having a gable top 12, first and second side walls 14, 16, a front wall 18, a rear wall 20, front and rear top panels 22, 24, top infolded or side gable panels 26, 28 and a top fin 30. The bottom wall 32, likewise appears as a conventional bottom wall. A longitudinal side seal wall 34 (or fifth panel, shown in blank form in FIG. 8) is formed adjacent one of the side walls 16 for sealing to, for example the front wall 18, to form the tubular carton form.

Figure 2:
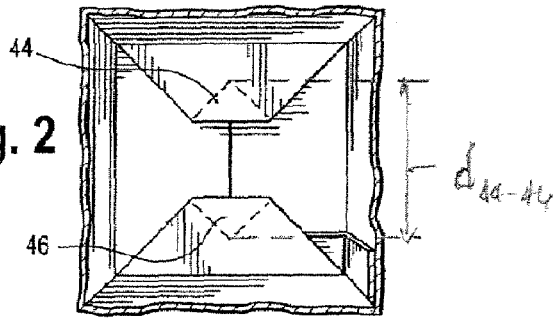
FIG. 2 is a view of the bottom wall of the carton as viewed from the inside of the carton.
Figure 3:
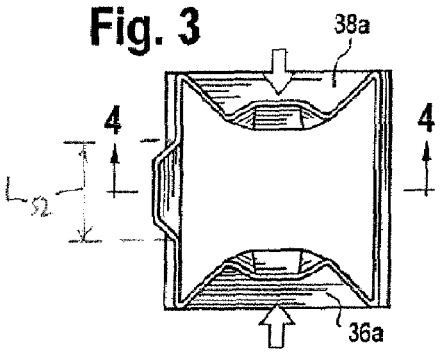
FIG. 3 is a view of the bottom of the carton as the gusset panels are being folded inward and as the gusset tip is urged outward as in-folding occurs.
Figure 4:
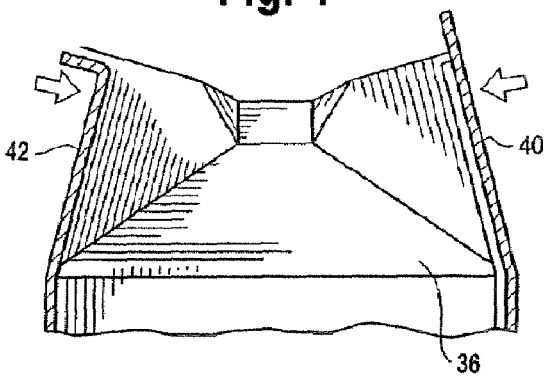
FIG. 4 is a cross-sectional view taken along line 4—4 of FIG. 3.
Figure 5:
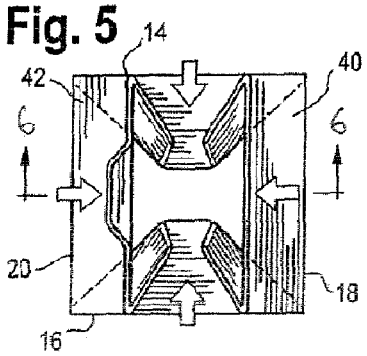
FIG. 5 is a further view of the bottom of the carton, similar to FIG. 3, showing the gusset panels folded further inward (than FIG. 3) and as the gusset tip further urged or held outward as in-folding occurs.
Figure 6:
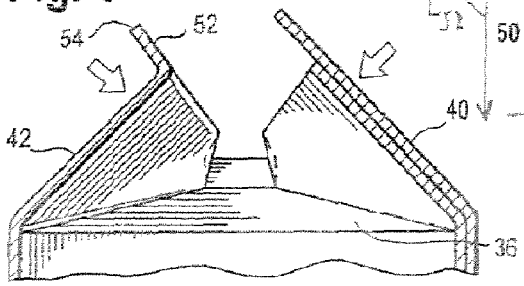
FIG. 6 is a cross sectional view taken along line 6—6 of FIG. 5.

The bottom wall 32 is formed from in-folded side gusset panels 36, 38 and front and rear or leading and trailing panels 40, 42. As seen in FIG. 2, as viewed from the inside of the carton 10, the tips 44, 46 of the infolded triangular or gusset panels 36, 38 are folded over or folded in, so that they lie under the triangular panels. That is, the tips 44, 46 are folded over so that they lie between the triangular panels 36, 38 and the leading and trailing bottom panels 40, 42. As seen from the inside of the package 10, the gusset panels 36, 38 appear to have a truncated triangular shape, thus defining a folded over edge (indicated at 48, 50), rather than leaving a raw or uncoated edge portion within the inside (product storage region) of the carton 10. In this arrangement, when the bottom panels 36–42 are heated and sealed, the tips 44, 46 lie within a sealed region and as such are isolated from the product storage region (or wetted region if used for liquid food packaging) of the carton 10. Those skilled in the art will recognize that the polymer coating on the paperboard softens and melts during the sealing process thus fusing the panels (coatings) to one another.

A tab or sixth panel 52 is folded over so that the raw or uncoated edge of the trailing panel 42 is also outside of the product storage or wetted region. That is, the uncoated edge is "shifted" from the end of the trailing panel 42 to the end of the tab panel 52 and, because the tab panel is folded over, the uncoated edge (indicated at 54) is thus, like the gusset tips 44, 46, sealed between the triangular panels 36, 38 and the bottom panels 40, 42. In a present package, the sixth panel 52 has a width (as at $w_{52}$) and a length (as at $l_{52}$). This configuration results in less material (about 3 percent less than known configurations) which provides a material cost savings.

Figure 8:
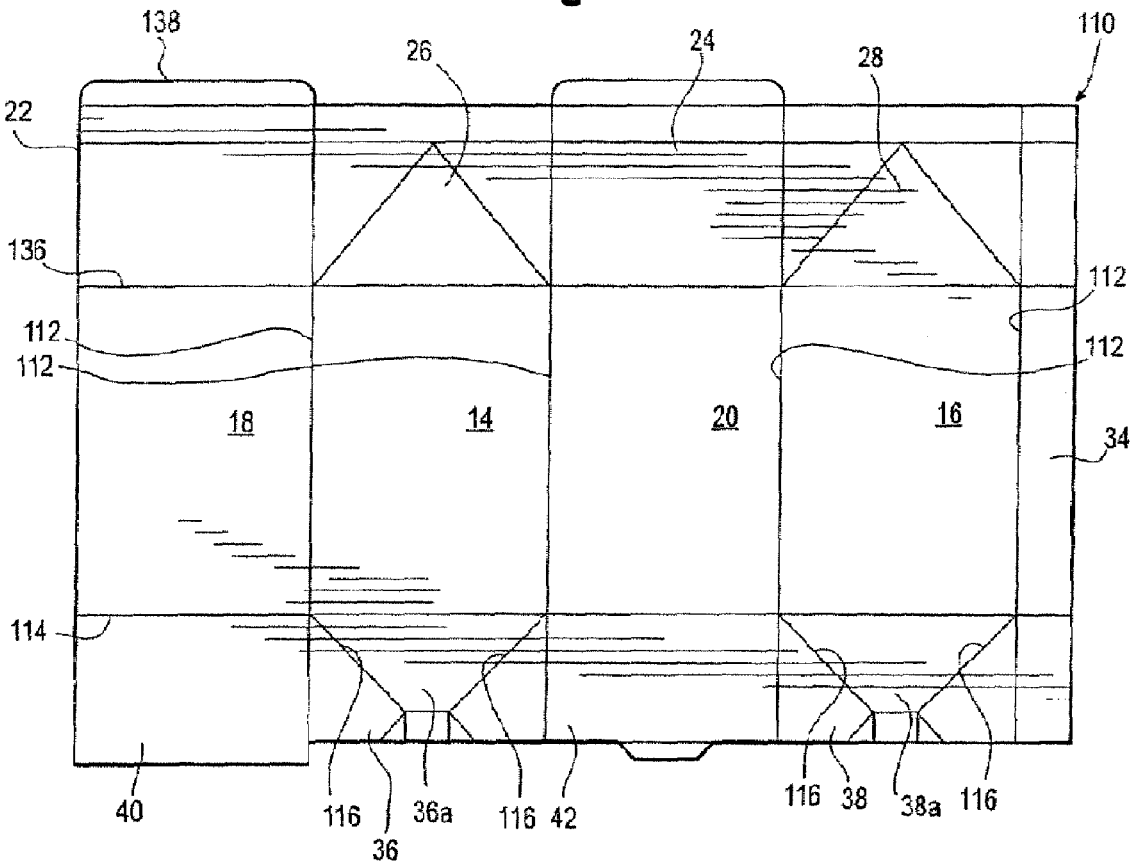
FIG. 8 is a plan view of a blank for the carton.
Figure 10:
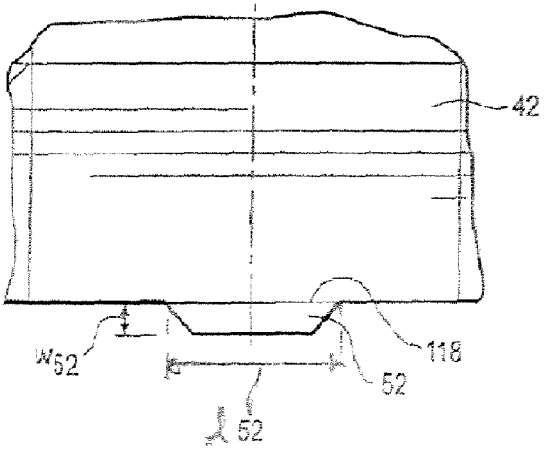
FIG. 10 is an enlarged view of the creases on the carton for forming the folded-in gusset tips.
Figure 9:
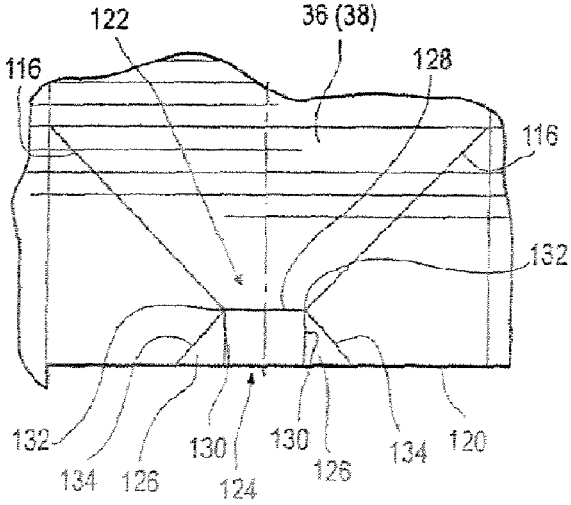
FIG. 9 is an enlarged view of the tab panel.

A blank 110 for the package 10 is shown in FIG. 8. The blank 110 has a plurality of panels that correspond to the front wall 18, the rear wall 20 and the side walls 14, 16. The panels 14–20 are partitioned from one another by a plurality of vertical score or crease lines 112. Those skilled in the art will recognize that the score or crease lines are those areas in the packaging material that facilitate folding the material along a predetermined, desired line. The lines are formed by, for example, embossing and the like. For purposes of the present disclosure, the terms score line and crease line are to be considered interchangeable.

A plurality of corresponding bottom panels 32–38 are partitioned from the corresponding or respective front, rear and side panels 14–20 by a lower horizontal score line 114. A plurality of lower diagonal score lines 116 further define the bottom gusset panels 36, 38 and are for folding purposes. The bottom or tab panel 52 (also referred to as the sixth panel) is separated from the trailing panel 42 by a score line 118.

In known carton blanks, the diagonal score lines extend fully from the horizontal score line separating the side panels from the bottom panels to the edge of the bottom panels (indicated at 120), and the score lines meet at the edge to form the triangular panels.

In the present blank 110, the diagonal score lines 116 (referred to herein as major diagonal score lines) terminate at a folding region 122 that includes a rectangular area 124 having smaller triangular areas 126 adjacent to the sides of the rectangular area 124. The areas 124, 126 are defined by a first horizontal score line 128 contiguous with a pair of spaced apart vertical score lines 130 (forming an upside-down U). The major diagonal score lines 116 terminate at the corners 132 of the U or at the respective junctures of the horizontal and vertical score lines 128, 130.

To accommodate the in-folding of the tips, 44, 46 each of the bottom gusset panels 36, 38 includes a pair of minor diagonal score lines 134 that extend from the edge 120 of the panel to the respective junctures (corners) 132 of the horizontal and vertical score lines 128, 130 with the major diagonal score lines 116.

FIGS. 3–6 illustrate the carton bottom 32 as it is being folded. The bottom side (gusset) panels 36, 38 are slightly infolded at the triangular portions 36*a*, 38*a*, of the panels 36, 38. In addition, the folding regions 122 are folded or pulled outwardly (see arrow A in FIG. 3) relative to the in-folding of the triangular portions 36*a*, 38*a* of the panels 36, 38. This forms the truncation of the gusset panels 36, 38 by folding the tips 44, 46 of the panels 36, 38.

Figure 7:
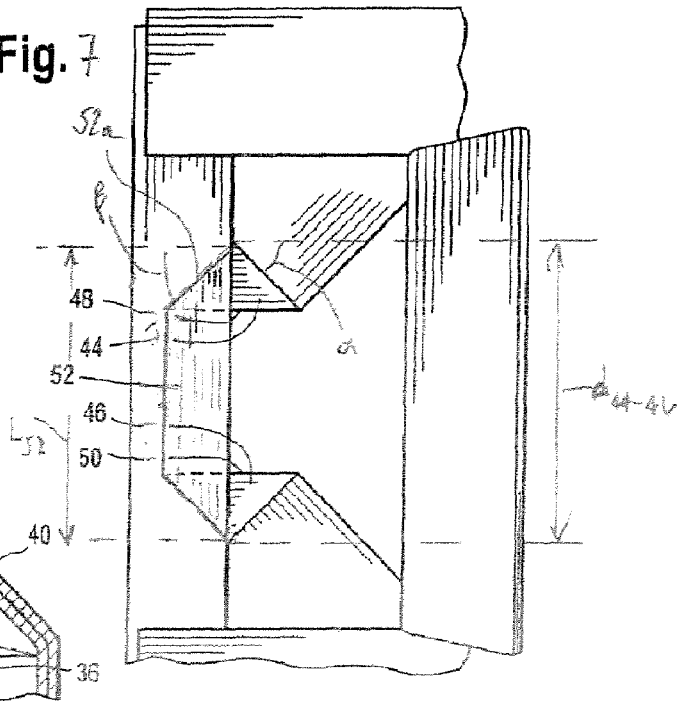
FIG. 7 is a view of the carton bottom with the leading panel removed for clarity of illustration, showing the folded-in gusset tips and the tab panel.

FIG. 7 illustrates the bottom 32 (exterior) of the carton with portions of the leading and trailing bottom panels 40, 42 cut away to better view the in-folded gusset tips 44, 46 and the optimized sixth panel 52. In these views, it can be seen that the sixth panel 52 is folded into the folds of the 44, 46. To this end, the sixth panel 52 has a length $l_{52}$ (at the base of the panel 52, at score line 118) that is slightly less than the distance $d_{44\text{-}46}$ between the triangular tips of panels 44, 46 (see FIG. 7). In addition, the angle $\alpha$ (formed by the folding of the tips 44, 46 (formed by or along crease lines 134) is less than or preferably about equal to the angle $\beta$ formed by the edge 52*a* of panel 52. In this manner, the panel 52 lies wholly within a "footprint" that is defined by the folded tips 44, 46, and the leading and trailing bottom panels 40, 42. Accordingly, this configuration prevents an excessive number of "layers" of material. It has been found that this configuration provides the necessary area for proper sealing, while minimizing the amount of material needed.

Referring now to FIGS. 1 and 8, the top or gable portion 12 of the carton 10 is formed as in a traditional manner. The front panel 22 is partitioned from the front wall 18 by an upper horizontal score line 136. Likewise, side top panels 26, 28 are partitioned by the score line 136 from their respective side wall panels 14, 16. The rear wall panel 20 corresponds to top panel 24 which is likewise partitioned therefrom by the upper horizontal score line 136. The top fin 30 of the package 10 is formed by a plurality of fin panels, indicated generally at 138 in FIG. 8. The fin panels 138 are partitioned from their corresponding top panels by horizontal score lines. Those skilled in the art will recognize the configuration and folding/assembly of the top (gable) 12 and fin 30.

All patents referred to herein, are hereby incorporated herein by reference, whether or not specifically done so within the text of this disclosure.

In the present disclosure, the words "a" or "an" are to be taken to include both the singular and the plural. Conversely, any reference to plural items shall, where appropriate, include the singular.

From the foregoing it will be observed that numerous modifications and variations can be effectuated without departing from the true spirit and scope of the novel concepts of the present invention. It is to be understood that no limitation with respect to the specific embodiments illustrated is intended or should be inferred. The disclosure is intended to cover by the appended claims all such modifications as fall within the scope of the claims.

What is claimed is:

1. A package having a bottom wall with in-folded gusset tips, comprising:

a plurality of upstanding side walls, each side wall contiguous or sealed to its adjacent side walls;

a sealed top; and a sealed bottom wall, the sealed bottom wall being formed from opposing leading and trailing panels, intermediate, opposing gusset panels, and a sixth panel contiguous with the trailing panel, the gusset panels being folded inwardly toward one another to form triangular panels, the triangular panels being disposed interior of the leading and trailing panels, ends of the gusset panels defining truncated regions folded away from one another, the sixth panel being folded rearwardly so as to lie between the leading and trailing panels and within a footprint of the truncated regions, wherein truncated regions are spaced a predetermined distance from one another and wherein the sixth panel has a length that is equal to or slightly less than the distance between edges of the truncated regions and within a footprint defined by the edges of the truncated regions, and the leading and trailing bottom panels.

2. The package in accordance with claim 1 wherein the truncated regions are formed between the triangular gusset panels and the leading and trailing panels.

3. The package in accordance with claim 1 wherein the leading panel is sealed over the trailing panel.

4. The package in accordance with claim 1 wherein the package has a gable-formed top.

5. The package in accordance with claim 1 wherein the triangular panels define an angle a as they overlie their respective gusset panels and wherein side edges of the sixth panel define an angle β as the sixth panel overlies the trailing panel, and wherein the angle a is less than or equal to the angle β.

6. A blank for a carton of the type having a plurality of upstanding side walls, each contiguous or sealed to its adjacent side wall and a sealed bottom wall with in-folded gusset tips, the blank comprising:

a rear wall panel, a front wall panel and opposing side wall panels, a vertical crease line partitioning each of the panels from adjacent panels;

a plurality of top panels adjacent to and contiguous with the front, rear and side wall panels, the top panels partitioned from their adjacent top panels by the vertical crease lines and separated from their respective side wall panels by a horizontal crease line;

a plurality of bottom wall panels adjacent to and contiguous with the front, rear and side wall panels, the bottom wall panels partitioned from their adjacent bottom wall panels by the vertical crease lines and separated from their respective side wall panels by a horizontal crease line, the bottom wall panels including a leading panel, a pair of opposing gusset panels, a trailing panel and a sixth panel contiguous with the trailing panel, the sixth panel having a length measured at a juncture with the trailing panel, the gusset panels each having a major diagonal crease line terminating at a folding region, each folding region defined by a rectangular area having minor diagonal crease lines extending from the rectangular area to an edge of the gusset panel, the major diagonal crease lines terminating at the folding region spaced from an edge of the gusset panel, wherein when the blank is folded and sealed to form the carton, the gusset panels are in-folded to form a pair of opposing truncated regions that are spaced a predetermined distance from one another and wherein the sixth panel length is equal to or slightly less than the distance between edges of the truncated regions and within a footprint defined by the edges of the truncated regions, and the leading and trailing bottom panels.

7. The blank in accordance with claim 6 wherein the folding region rectangular area is defined by a crease line parallel to an edge of the gusset panel and spaced from the edge a predetermined distance, and a pair of spaced perpendicular crease lines.

* * * * *